United States Patent [19]

Karppinen et al.

[11] Patent Number: 5,065,877

[45] Date of Patent: Nov. 19, 1991

[54] CONTAINER WITH LID

[76] Inventors: Eino Karppinen, Skiftesvaägen 38, S-183 38 Täby; Göran Sjönell, Askrikevägen 11,, S-181 46 Lidingö, both of Sweden

[21] Appl. No.: 598,220

[22] Filed: Oct. 16, 1990

[30] Foreign Application Priority Data

Oct. 17, 1989 [SE] Sweden ..... 8903419

[51] Int. Cl.[5] ..... B65D 43/16

[52] U.S. Cl. ..... 215/239; 215/235

[58] Field of Search ..... 215/235, 239, 242, 218, 215/304, 223, 237; 720/335

[56] References Cited

U.S. PATENT DOCUMENTS

| | | | |
|---|---|---|---|
| 1,037,051 | 8/1912 | Ramsey | 215/235 |
| 1,447,117 | 2/1923 | Balison et al. | 215/235 |
| 1,698,528 | 1/1929 | Batchelor | 215/235 |
| 2,442,745 | 6/1948 | Alexander | 215/235 |
| 3,393,816 | 7/1968 | Grimm | 215/223 |

FOREIGN PATENT DOCUMENTS

| | | | |
|---|---|---|---|
| 2158680 | 5/1973 | Fed. Rep. of Germany | 215/235 |
| 313382 | 12/1933 | Italy | 215/235 |

*Primary Examiner*—Stephen Marcus
*Assistant Examiner*—Paul A. Schwarz
*Attorney, Agent, or Firm*—Michael, Best & Friedrich

[57] ABSTRACT

A container (1) having a lid part (4) which is pivotally connected to the container by means of a pivot device (6), and which is provided with a handle part (5) which extends from the pivot device (6) in a direction opposite to the direction in which the lid part (4) extends. The container has a bottom and an outer surface which extends from the bottom, and presents at the end of the surface remote from the bottom a neck portion (2) which is terminated with an opening. The container is characterized in that the pivot device (6) can be moved circumferentially around the neck portion (2) so that when closing the lid part (4), the handle part (5) is moved from a position in which it extends essentially contiguous with the container surface to another position in which the handle part (5) is spaced further from the container surface.

13 Claims, 2 Drawing Sheets

CONTAINER WITH LID

The present invention relates to a container having a lid part which is pivotally attached thereto, in accordance with the preamble of claim 1. The lid part is of a conventional kind and is intended to close the container opening with a press fit, a snap-fit or the like. The container may be a can, flask, bottle or the like and is primarily intended to hold medicines and poisonous substances, both in tablet and in liquid form, although it may, of course, also be used for other substances such as laundry detergents and dish-washing detergents.

The function of the lids of such containers as cans, bottles and the like is almost exclusively to seal the container opening or to prevent the contents of the container from escaping therefrom. This means that the lid must be held over the opening with a certain degree of tension, achieved with the aid, for instance, of a press fit, a snap-over fit, a screw fit or a corresponding fit. Consequently, it is necessary to exert a certain amount of force, at times considerable force, to open the container by removing the lid from the opening thereof. In the case of containers which are intended to hold poisonous substances, such as substances which contain drugs, the container lid shall incorporate means which render it difficult to open the lid, so as to obtain a so-called "child-proof" lid or cap. When opening a container of this kind, it is normally necessary to perform two separate actions. A number of different kinds of containers having "child-proof" lids are available commercially.

All of the lidded containers of the aforesaid kind exhibit the drawback that handicapped and sick people have insurmountable difficulty in opening the lid. People who are weak from illness or people who have only one usable hand find great difficulty in opening present-day packages, such as medicine cans, medicine bottles or the like, and also other types of packages of course, without taking special measures or using special tools, and are constantly at risk of the contents spilling from the container and entering the eyes of the person concerned. In such an event, the person concerned is unable to re-seal the container after use, which in turn will mean that the contents of the unsealed container are exposed to external influences and that the content of the container can readily be reached by children, for instance. This problem is a general problem and, of course, becomes more serious when the type of lidded container concerned is of "child-proof" construction.

The object of the present invention is to eliminate these drawbacks and to provide a lidded container, such as a can, flask, bottle or the like, which can be opened very easily with only one hand without requiring a large degree of force, and which cannot be opened by children. This object is achieved with the inventive lidded container having the characteristic features set forth in the following claims.

The invention will now be described in more detail with reference to an exemplifying embodiment thereof and with reference to the accompanying drawings, in which FIG. 1 illustrates a container in the form of a can with a lid fitted thereon;

Figure 1:
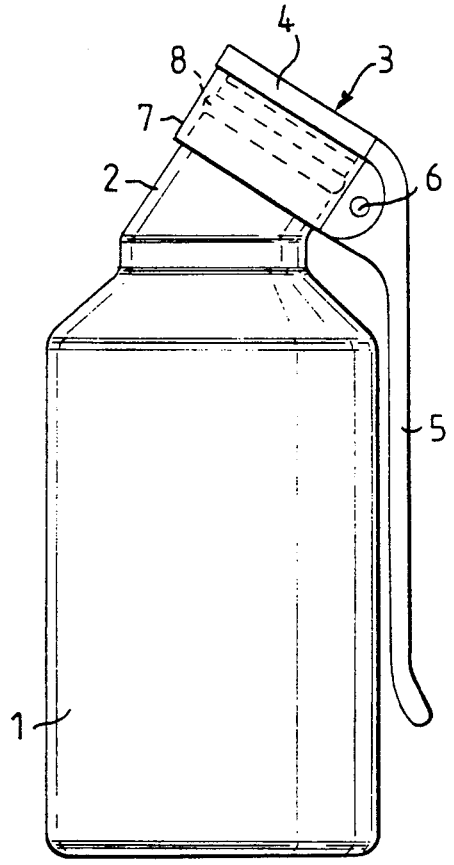

Shown in the Figures is a container 1 in the form of a bottle or can, which has a neck portion 2 which terminates in an opening in a conventional manner. The can opening can be closed with the aid of a lid construction 3, which comprises a lid part 4 and a handle part 5, said parts being formed integrally with one another. The lid part 4 is held in sealing engagement with the opening in a conventional manner, by means of some type of snap-on type fitting and forms no part of the present invention.

The lid 3 is pivotally connected to an annulus or collar 7 by means of a pivot pin 6 located on a part between the lid part 4 and the handle part 5. In the illustrated case, the neck portion has provided thereon a bead 8 which is accommodated in a corresponding groove in the collar 7, thereby enabling the collar together with the lid 3 to be fitted over the neck portion 2 and snapped firmly thereon. It will be understood that the collar 7, with the lid 3, are rotatable around the neck portion 2.

The length of the handle part 5 in relation to the length dimension of the lid part, seen in the pivotal plane of said lid part, is much greater than said length dimension. The ratio between the length dimension of the lid part and the length of the handle part may, of course, vary in dependence on the type of container or package concerned, and also on the intended purpose of said container and its contents, although the handle part will nevertheless, of course, have a substantial length.

Figure 2:
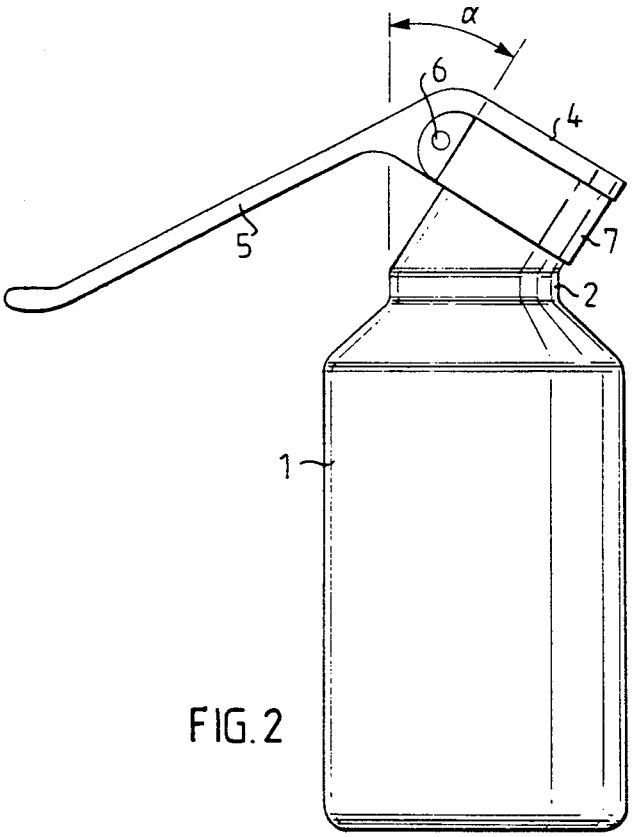
FIG. 2 illustrates the container with the lid rotated through 180°.
Figure 3:
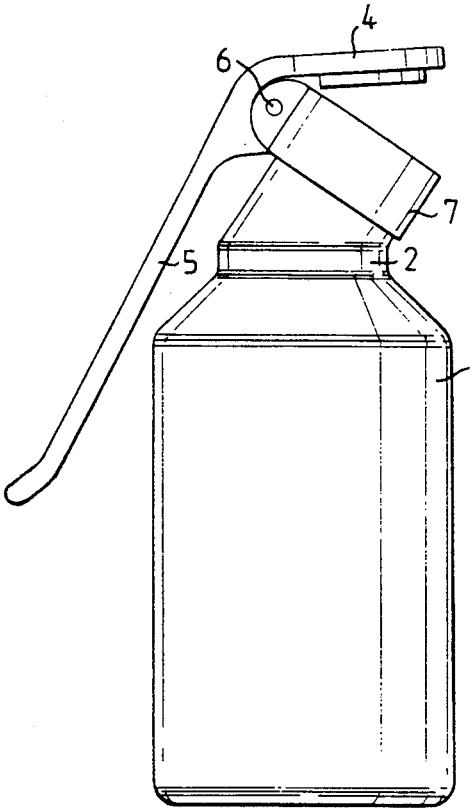
FIG. 3 illustrates the lid when open.

FIG. 1 shows the lid 3 in its closed or sealing position, in which the lid, together with the collar 7, has been rotated so that the handle part 5 is located closely adjacent to and along the outer wall of the container 1. It is now impossible to open the lid with the aid of the handle part 5 (with reference to the drawing, it will be understood that the lid-part/handle-part have a given degree of spring). When the container 1 is to be opened, the lid 3 is rotated through 180°, as illustrated in FIG. 2, whereby the handle part 5 will extend outwardly from the container 1 at a substantial distance from the surface of said container, owing to the inclination of the neck portion 2. The container can now be opened by applying pressure to the handle part 5, as illustrated in FIG. 3, whereby the lid part 4 is swung up to expose the container opening.

The lid part 4 and the handle part 5 thus operate as a double-arm lever with the fulcrum point lying on the pivot 6, thereby enabling the lid of the container to be opened from its position shown in FIG. 2 even by a handicapped person and then even with only one hand. The lid is also "child-proof" in that the lid cannot be opened when in the position illustrated in FIG. 1, but must first be rotated through 180° before it can be opened. Two manipulations of the hand are thus required to empty the contents from the container.

Figure 4:
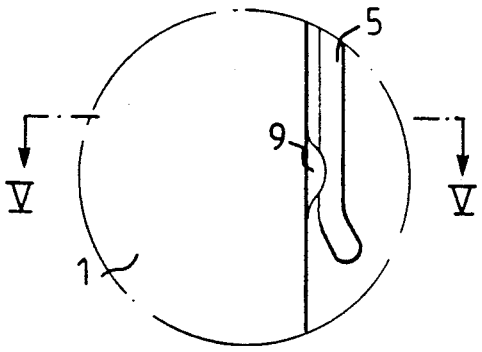
FIGS. 4 and 5 are part views of a modified embodiment, taken from one side and in cross-section respectively.
Figure 5:
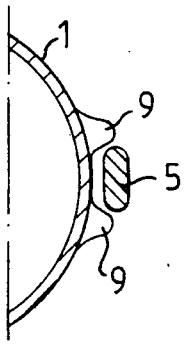

FIGS. 4 and 5 illustrate how one further manipulating step can be incorporated in the inventive container, by mounting on the outer surface of the container two projections 9 and locating the handle part 5 between said projections when the lid is in its FIG. 1 position. Thus, before the container can be opened, it is necessary first to move the handle part 5 radially outwards and lift the handle part over one of the projections 9, and then to twist the lid 3 to the position shown in FIG. 2. As before mentioned, it will be understood that the handle part 5 has a certain degree of spring. It will also be understood that the pivot means 6 can be formed in various ways and that the actual collar 7 can be moulded from a plastics material integrally with the lid 3, while producing some kind of integrated hinge or the like. This constitutes no part of the invention, however.

The angle at which the neck portion is inclined to the cylindrical wall of the container can vary in dependence on the contents thereof. For instance, it can be mentioned that in the case of tablets a suitable angle $\alpha$ (see FIG. 2) lies between 10° and 25°, whereas when the container contains liquid the angle o may be about 5° (and smaller, of course, depending on purpose and need).

Figure 6:
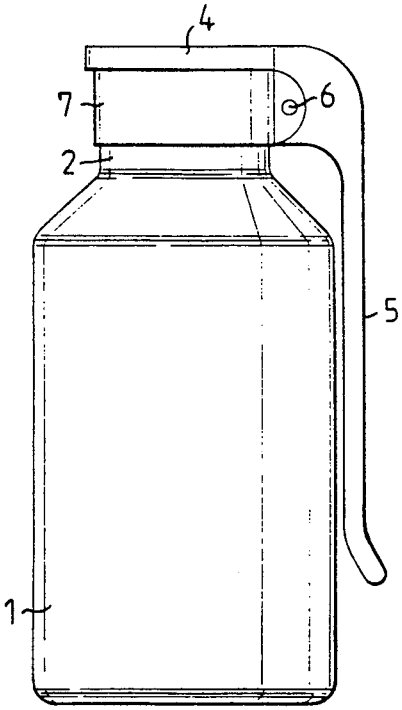
FIGS. 6 and 7 illustrate an alternative embodiment of the invention seen from one side and from above respectively.
Figure 7:
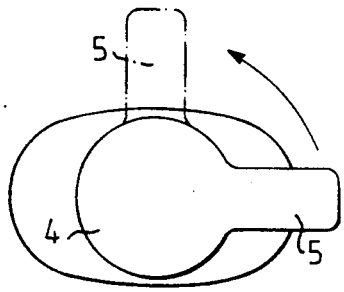

FIGS. 6 and 7 illustrate an alternative embodiment which exemplifies the inventive concept. In the case of this alternative embodiment, the neck portion 2 of the container 1 is not inclined in relation to the outer surface of the container. In other respects, the container 1 has a lid 3 comprising a collar 7 which is pivotally mounted on the neck portion 2, similar to the aforedescribed embodiment. The actual container of the alternative embodiment, however, has an oval crosssection, as shown in FIG. 7. In order to open this container, the lid 3 is rotated from the position shown in FIG. 6 through 90° to the handle position shown in broken lines in FIG. 7. The handle is now spaced from the outer surface of the container, so that the lid can be opened by exerting pressure on the handle. This container embodiment is less easy to grip when opening the container than the earlier described embodiment, since the handle part 5 inclines inwardly towards the container surface when opening the lid, although said embodiment can have certain applications.

We claim:

1. A container (1) having a lid part (4) which is pivotally connected (6) to the container and is provided with a handle part (5) which extends from the pivot (6) in a direction opposite to a direction in which the lid part (4) extends, said container having a bottom and an outer wall which extends from said bottom, and presents at the end of said wall remote from said bottom, a neck portion (2) which is terminated with an opening, characterized in that the pivot (6) can be moved circumferentially around the neck portion (2) such that when opening the lid part (4), the handle part (5) moves from one position in which the handle part extends essentially contiguous with the outer wall of the container such that the outer wall prevents movement of the handle part to open the lid part, to another position in which the handle part (5) is spaced further from said outer wall such that said outer wall permits movement of the handle part to open the lid part.

2. A container according to claim 1, characterized in that the neck portion (2) is inclined in relation to the outer surface of the container (1).

3. A container according to claim 1, characterized in that the container (1) has an oval or elongated cross-section.

4. A container according to claim 3, characterized in that the pivot (6) is located on a collar (7) which is rotatably mounted on the neck portion (2).

5. A container according to claim 2, characterized in that the neck portion is inclined at an angle of up to 30° in relation to the outer surface of the container.

6. A container according to claim 5, characterized in that the outer surface of the container has mounted firmly thereon two projections (9) between which the handle part (5) is located in said one position.

7. A container according to claim 1, characterized in that the pivot (6) is located on a collar (7) which is rotatably mounted on the neck portion (2).

8. A container according to claim 2, characterized in that the pivot (6) is located on a collar (7) which is rotatably mounted on the neck portion (2).

9. A container according to claim 2, characterized in that the outer surface of the container has mounted firmly thereon two projections (9) between which the handle part (5) is located in said one position.

10. A container according to claim 3, characterized in that the outer surface of the container has mounted firmly thereon two projections (9) between which the handle part (5) is located in said one position.

11. A container according to claim 4, characterized in that the outer surface of the container has mounted firmly thereon two projections (9) between which the handle part (5) is located in said one position.

12. A container (1) having a lid part (4) which is pivotally connected (6) to the container and is provided with a handle part (5) which extends from the pivot (6) in a direction opposite to a direction in which the lid part (4) extends, said container having a bottom and an outer wall which extends from said bottom, and presents at the end of said wall remote from said bottom, a neck portion (2) which is terminated with an opening, characterized in that the pivot (6) can be moved circumferentially around the neck portion (2) such that when opening the lid part (4), the handle part (5) moves from one position in which it extends essentially contiguous with the outer wall of the container to another position in which the handle part (5) is spaced further from said outer wall, and in that the outer surface of the container has mounted firmly thereon two projections (9) between which the handle part (5) is located in said one position.

13. A container apparatus comprising a container having a bottom and an outer wall extending from said bottom and defining a neck portion terminating with an opening, and a lid assembly including a collar, a lid which is pivotally connected to said collar at a pivot point and which extends from said pivot point in a first direction, and a handle extending from said pivot point in a second opposite direction, said collar being rotatable about said neck portion such that said handle is selectively moveable from a first position wherein said outer wall of said container prevents movement of said handle to open said lid, to a second position wherein said outer wall permits movement of said handle to open said lid.

* * * * *